US010262609B2

(12) United States Patent
Dai

(10) Patent No.: US 10,262,609 B2
(45) Date of Patent: Apr. 16, 2019

(54) SCANNING DRIVING CIRCUIT WITH PULL-DOWN MAINTAIN MODULE AND LIQUID CRYSTAL DISPLAY APPARATUS WITH THE SCANNING DRIVING CIRCUIT

(71) Applicant: Wuhan China Star Optoelectronics Technology Co., Ltd., Wuhan, Hubei (CN)

(72) Inventor: Ronglei Dai, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 172 days.

(21) Appl. No.: 15/011,506

(22) Filed: Jan. 30, 2016

(65) Prior Publication Data

US 2017/0124969 A1 May 4, 2017

(30) Foreign Application Priority Data

Oct. 31, 2015 (CN) ..... 2015 1 0732448

(51) Int. Cl.
*G09G 3/36* (2006.01)

(52) U.S. Cl.
CPC ..... *G09G 3/3648* (2013.01); *G09G 3/3677* (2013.01); *G09G 2310/0283* (2013.01); *G09G 2310/0286* (2013.01); *G09G 2310/0289* (2013.01); *G09G 2310/061* (2013.01); *G09G 2310/08* (2013.01); *G09G 2330/021* (2013.01)

(58) Field of Classification Search
CPC ..... G09G 2310/0286
See application file for complete search history.

(56) References Cited

U.S. PATENT DOCUMENTS

| | | | | |
|---|---|---|---|---|
| 5,534,892 | A * | 7/1996 | Tagawa | G06F 3/0412 178/20.01 |
| 9,324,256 | B2 * | 4/2016 | Liao | G09G 3/3674 |
| 2006/0055645 | A1 * | 3/2006 | Kim | G09G 3/3666 345/87 |
| 2007/0063950 | A1 * | 3/2007 | Shin | G11C 19/184 345/92 |

(Continued)

FOREIGN PATENT DOCUMENTS

| | | |
|---|---|---|
| CN | 104537994 A | 4/2015 |
| CN | 104766584 A | 7/2015 |

*Primary Examiner* — Chad M Dicke
(74) *Attorney, Agent, or Firm* — Andrew C. Cheng

(57) ABSTRACT

The disclosure discloses a scanning driving circuit and a liquid crystal display apparatus, the scanning driving circuit including a first driving circuit and a second driving circuit, each of the first driving circuit and the second driving circuit including a number of driving units in cascade connections, and each of the driving units including: a forward and reverse scanning module to output a forward scanning signal, a reverse scanning signal and an optional signal; a pull-down maintain module connected to the forward and reverse scanning module and to receive the optional signal from the forward and reverse scanning module and output a pull down signal according to the optional signal; a control module connected to the forward and reverse scanning module and the pull-down maintain module; a reset module connected to the pull-down maintain module and the control module to reset the electrical potential of the scanning line.

9 Claims, 4 Drawing Sheets

(56) References Cited

U.S. PATENT DOCUMENTS

2008/0062112 A1* 3/2008 Umezaki ..... G09G 3/342 345/100
2008/0094320 A1* 4/2008 Parikh ..... G09G 3/3233 345/76
2008/0191980 A1* 8/2008 Jeon ..... G09G 3/3677 345/87
2009/0128533 A1* 5/2009 Tsubata ..... G02F 1/13624 345/209
2009/0167668 A1* 7/2009 Kim ..... G09G 3/3677 345/100
2012/0050234 A1* 3/2012 Jang ..... G09G 3/3225 345/204
2012/0133392 A1* 5/2012 Wang ..... G09G 3/3677 326/83
2012/0139599 A1* 6/2012 Chen ..... G09G 3/3677 327/203
2013/0077736 A1* 3/2013 Son ..... G09G 3/20 377/69
2013/0135284 A1* 5/2013 Tseng ..... G11C 19/28 345/212
2014/0043274 A1* 2/2014 Yao ..... G06F 3/0416 345/173
2014/0098014 A1* 4/2014 Liao ..... G09G 3/3674 345/99
2014/0168050 A1* 6/2014 Gu ..... G09G 3/3611 345/100
2014/0253424 A1* 9/2014 Yu ..... G11C 19/28 345/100
2014/0320427 A1* 10/2014 Lee ..... G06F 3/0416 345/173
2014/0355731 A1* 12/2014 Chien ..... G11C 19/28 377/64
2015/0154928 A1* 6/2015 Abe ..... G09G 1/005 345/213
2015/0161958 A1* 6/2015 Hsu ..... G09G 3/3674 345/99
2015/0179277 A1* 6/2015 Pai ..... G09G 3/20 377/68
2015/0187323 A1* 7/2015 Jin ..... G09G 5/003 345/215
2015/0213746 A1* 7/2015 Kim ..... G09G 3/3677 345/215
2015/0228243 A1* 8/2015 Liao ..... G09G 3/3677 345/212
2015/0248869 A1* 9/2015 Miyake ..... G09G 3/3677 345/205
2015/0262703 A1* 9/2015 Murakami ..... G09G 3/20 345/214
2015/0294734 A1* 10/2015 Chan ..... G11C 19/28 327/109
2015/0325190 A1* 11/2015 Cao ..... G11C 19/28 345/100
2015/0356934 A1* 12/2015 Yamashita ..... G09G 3/3611 345/205
2016/0049126 A1* 2/2016 Zhang ..... G09G 3/3648 345/173
2016/0259475 A1* 9/2016 Nakamura ..... G06F 3/0416
2016/0328076 A1* 11/2016 Pan ..... G06F 3/0416
2016/0351105 A1* 12/2016 Park ..... G02F 1/13
2016/0351156 A1* 12/2016 Wu ..... G11C 19/28
2017/0084237 A1* 3/2017 Kang ..... G09G 3/20
2017/0092214 A1* 3/2017 Xiao ..... G09G 3/3677
2017/0178584 A1* 6/2017 Ma ..... G09G 3/3677

* cited by examiner

SCANNING DRIVING CIRCUIT WITH PULL-DOWN MAINTAIN MODULE AND LIQUID CRYSTAL DISPLAY APPARATUS WITH THE SCANNING DRIVING CIRCUIT

FIELD OF THE INVENTION

The present disclosure relates to the field of liquid crystal display technology, and in particular to a scanning driving circuit and a liquid crystal display apparatus with the scanning driving circuit.

BACKGROUND OF THE INVENTION

The gate driver on array (GOA) scanning driving circuit is adapted in the liquid crystal display technology, such as to form the scanning driving signal circuit and the touch scanning circuit on the array substrate by the conventional process of the thin-film transistor crystal display to achieve the technology of driving method of scanning gate line by line and the touch function. Now the touch scanning is performed between two adjacent scanning lines, in order to avoid the touch scanning signal influence of the normal display of the liquid crystal display apparatus during the touch scanning, the transistors controlled by the scanning line are turn off during the touch scanning. This will increase the number of the scanning driving signal interrupting and the electrical charge residual in the scanning line after the touch scanning in the normal display of the liquid crystal display apparatus.

SUMMARY OF THE INVENTION

The main technology issue to be solved in the disclosure is to provide a scanning driving circuit and a liquid crystal display apparatus to decrease the signal break off times of the scanning driving circuit and by the reset of the driving unit to decrease the residual of the electrical charge of the scanning line after the touch scanning.

In order to solve the issue mentioned above, the first technology provided in this disclosure is provided a scanning driving circuit, the scanning driving circuit including a first driving circuit and a second driving circuit, each of the first driving circuit and each of the second driving circuit including a plurality of driving unit in cascade connections, and each of the driving unit including:

a forward and reverse scanning module to output a forward scanning signal, a reverse scanning signal and a pull-down signal;

a pull-down maintain module connected to the forward and reverse scanning module and to receive the pull-down signal from the forward and reverse scanning module and output a pull down signal according to the pull-down signal;

a control module connected to the forward and reverse scanning module and the pull-down maintain module, and to receive the forward scanning signal and the reverse scanning signal from the forward and reverse scanning module and the pull down signal from the pull-down maintain module then output a high electrical level or a low electrical level scanning driving signal;

a scanning line to transmit the scanning driving signal to the pixel unit; and a reset module connected to the pull-down maintain module and the control module to reset the electrical potential of the scanning line.

Wherein the forward and reverse scanning module further including a first controllable switch and a second controllable switch, a control terminal of the first controllable switch is connected to an upper level scanning signal, an input terminal of the first controllable switch is connected to a forward scanning control potential, an output terminal of the first controllable switch is connected to the control module, the pull-down maintain module and an output terminal of the second controllable switch, an input terminal of the second controllable switch is connected to a reverse scanning control potential, and a control terminal of the second controllable switch is connected to a next level scanning signal.

Wherein the pull-down maintain module further including a third to sixth controllable switches, a control terminal of the third controllable switch is connected to the forward scanning control potential, an input terminal of the third controllable switch is connected to a next level clock signal, an output terminal of the third controllable switch is connected to an output terminal of the fourth controllable switch, and a control terminal of the fifth controllable switch, a control terminal of the fourth controllable switch is connected to the reverse scanning control potential, an input terminal of the fourth controllable switch is connected to an upper level clock signal, an input terminal of the fifth controllable switch is connected to a turn on electrical potential terminal, an output terminal of the fifth controllable switch is connected to a control terminal of the sixth controllable switch and the control module, an output terminal of the sixth controllable switch is connected to the output terminal of the first controllable switch and an input terminal of the sixth controllable switch is connected to a turn off electrical potential terminal and the control module.

Wherein the control module further including a seventh to tenth controllable switches and a capacitor, a control terminal of the seventh controllable switch is connected to the turn on electrical potential terminal, an input terminal of the seventh controllable switch is connected to the output terminal of the first controllable switch, an output terminal of the seventh controllable switch is connected to a control terminal of the tenth controllable switch, an input terminal of the tenth controllable switch is connected to a current level clock signal, an output terminal of the tenth controllable switch is connected to the scanning line and the reset module, a control terminal of the eighth controllable switch is connected to the output terminal of the first controllable switch, an input terminal of the eighth controllable switch is connected to the turn off electrical potential terminal, an output terminal of the eighth controllable switch is connected to the control terminal of the sixth controllable switch and a control terminal of the ninth controllable switch, an input terminal of the ninth controllable switch is connected to the turn off electrical potential terminal, an output terminal of the ninth controllable switch is connected to an output terminal of the tenth controllable switch and the scanning line, the capacitor is connected between the control terminal and the input terminal of the ninth controllable switch.

Wherein the reset module further including an eleventh controllable switch, a control terminal of the eleventh controllable switch receives a reset signal, an input terminal of the eleventh controllable switch is connected to the turn off electrical potential terminal, an output terminal of the eleventh controllable switch is connected to the ninth controllable switch, the tenth controllable switch and the scanning line.

Wherein the control terminal of the first controllable switch in the first driving unit of the first driving circuit is connected to the first driving terminal, the control terminal of the first controllable switch in the second and others driving units of the first driving circuit is connected to the upper level scanning line, the control terminal of the eleventh controllable switch in each driving unit of the first driving circuit is connected to the second driving terminal; the control terminal of the first controllable switch in the second and others driving units of the second driving circuit is connected to the upper level scanning line, the control terminal of the eleventh controllable switch of each driving unit of the second driving circuit is connected to the first driving terminal.

Wherein the first to the eleventh controllable switches are all N-type MOS transistors.

Wherein the quantity of the driving units in the first driving circuit is the same with the quantity of the driving units in the second driving circuit and the touch scanning circuit is formed between the first driving circuit and the second driving circuit and two frame interval.

Wherein the first driving circuit is set in the right-and-left sides of the upper portion of the liquid crystal display apparatus and the second driving circuit is set in the right-and-left sides of the lower portion of the liquid crystal display apparatus.

In order to solve the technology mentioned above, another technology approach provided in this disclosure is to provide a liquid crystal display apparatus including a scanning driving circuit mentioned above.

The advantage of the disclosure to differ with conventional technology is by controlling the conducting and reset of the first driving circuit and the second driving circuit of the scanning driving circuit in the present disclosure to achieve the centralize setting of the touch scanning in the middle of the scanning in the scanning driving circuit to decrease the signal break off times of the scanning driving circuit and by the reset of the driving unit to decrease the residual of the electrical charge of the scanning line after the touch scanning.

BRIEF DESCRIPTION OF THE DRAWINGS

The following detailed descriptions accompanying drawings and the embodiment of the present disclosure make the aspect of the present disclosure and the other beneficial effect more obvious.

DETAILED DESCRIPTION OF THE PREFERRED EMBODIMENTS

The specific components or items are used in the specification and claims. Those skilled in the art can use other possible modifications and variations in the same components or items. The specification and claim will not distinguish the different terms to the items or components but by the functions. Following is the detail description illustrated by the figures and the embodiments.

Figure 1:
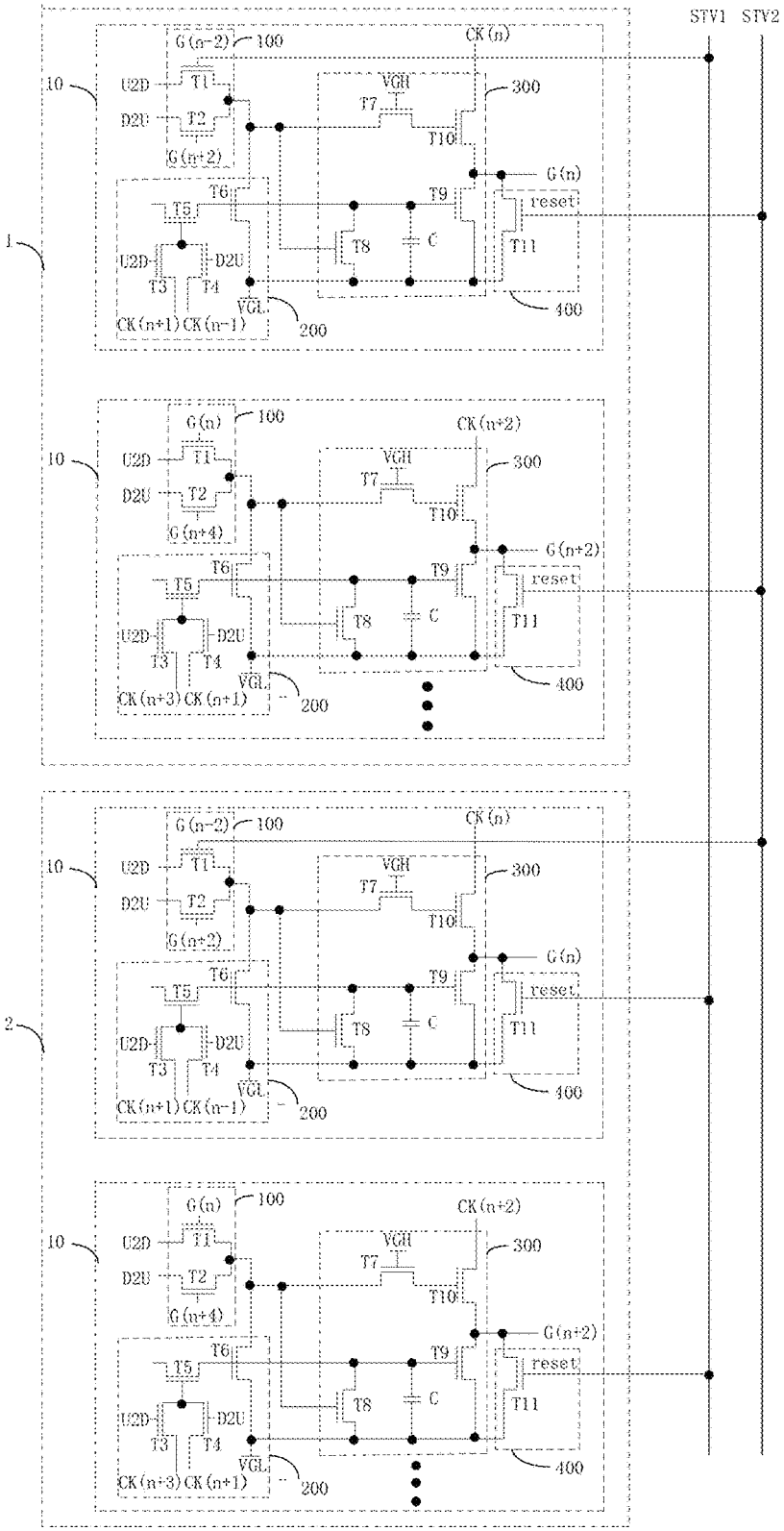
FIG. 1 is a schematic view illustrating the scanning driving circuit structure according to the present disclosure.
Figure 2:
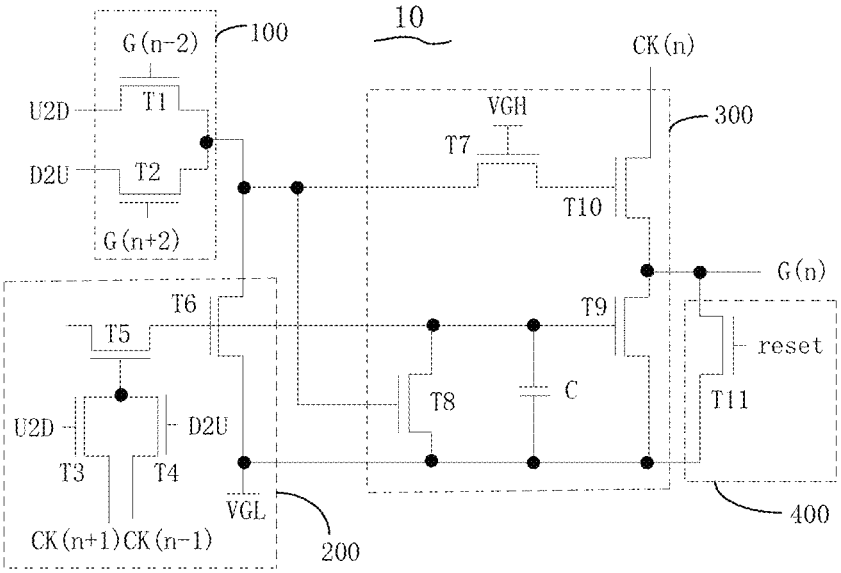
FIG. 2 is schematic view of FIG. 1 illustrates a driving unit structure according to the present disclosure.

Referring to FIG. 1 and FIG. 2, the scanning driving circuit of the present disclosure includes a first driving circuit 1 and a second driving circuit 2. Each of the first driving circuit 1 and each of the second driving circuit 2 include a plurality of driving unit 10 in cascade connections, and each of the driving unit 10 including a forward and reverse scanning module 100 to output a forward scanning signal, a reverse scanning signal and a pull-down signal; a pull-down maintain module 200 connected to the forward and reverse scanning module 100 and to receive the pull-down signal from the forward and reverse scanning module 100 and output the pull down signal according to the pull-down signal; a control module 300 connected to the forward and reverse scanning module 100 and the pull-down maintain module 200, and to receive the forward scanning signal and the reverse scanning signal from the forward and reverse scanning module 100 and the pull down signal from the pull-down maintain module 200 then output a high electrical level or a low electrical level scanning driving signal; a scanning line to transmit the scanning driving signal to the pixel unit; and a reset module 400 connected to the pull-down maintain module 200 and the control module 300 to reset the electrical potential of the scanning line.

The forward and reverse scanning module 100 includes a first controllable switch T1 and a second controllable switch T2, a control terminal of the first controllable switch T1 is connected to the upper level scanning signal, an input terminal of the first controllable switch T1 is connected to a forward scanning control potential U2D, an output terminal of the first controllable switch T1 is connected to the control module 300, the pull-down maintain module 200 and an output terminal of the second controllable switch T2, an input terminal of the second controllable switch T2 is connected to a reverse scanning control potential D2U, and a control terminal of the second controllable switch T2 is connected to the next level scanning signal.

The pull-down maintain module 200 includes a third to sixth controllable switch T3-T6, a control terminal of the third controllable switch T3 is connected to the forward scanning control potential U2D, an input terminal of the third controllable switch T3 is connected to a next level clock signal, an output terminal of the third controllable switch T3 is connected to an output terminal of the fourth controllable switch T4, and a control terminal of the fifth controllable switch T5, a control terminal of the fourth controllable switch T4 is connected to the reverse scanning control potential D2U, an input terminal of the fourth controllable switch T4 is connected to an upper level clock signal, an input terminal of the fifth controllable switch T5 is connected to a turn on electrical potential terminal VGH, an output terminal of the fifth controllable switch T5 is connected to a control terminal of the sixth controllable switch T6 and the control module 300, an output terminal of the sixth controllable switch T6 is connected to the output terminal of the first controllable switch and an input terminal of the sixth controllable switch T6 is connected to a turn off electrical potential terminal and the control module.

The control module 300 includes a seventh to tenth controllable switch T7-T10 and a capacitor C, a control terminal of the seventh controllable switch T7 is connected to the turn on electrical potential terminal VGH, an input terminal of the seventh controllable switch T7 is connected to the output terminal of the first controllable switch T1, an output terminal of the seventh controllable switch T7 is connected to a control terminal of the tenth controllable switch T10, an input terminal of the tenth controllable switch T10 is connected to a current level clock signal, the output terminal of the tenth controllable switch T10 is connected to the scanning line and the reset module 400, a control terminal of the eighth controllable switch T8 is connected to the output terminal of the first controllable switch T1, an input terminal of the eighth controllable switch T8 is connected to the turn off electrical potential terminal VGL, an output terminal of the eighth controllable switch T8 is connected to the control terminal of the sixth controllable switch T6 and a control terminal of the ninth controllable switch T9, an input terminal of the ninth controllable switch T9 is connected to the turn off electrical potential terminal VGL, an output terminal of the ninth controllable switch T9 is connected to an output terminal of the tenth controllable switch T10 and the scanning line, the capacitor C is connected between the control terminal and the input terminal of the ninth controllable switch T9.

The reset module 400 includes an eleventh controllable switch T11, a control terminal of the eleventh controllable switch T11 receives a reset signal, an input terminal of the eleventh controllable switch T11 is connected to the-turn off electrical potential terminal VGL, an output terminal of the eleventh controllable switch T11 is connected to the ninth controllable switch T9, the tenth controllable switch T10 and the scanning line.

The control terminal of the first controllable switch T1 in the first driving unit of the first driving circuit 1 is connected to the first driving terminal, the control terminal of the first controllable switch T1 in the second and others driving units of the first driving circuit 1 is connected to the upper level scanning line, the control terminal of the eleventh controllable switch T11 in each driving unit of the first driving circuit 1 is connected to the second driving terminal; the control terminal of the first controllable switch T1 in the first driving unit of the second driving circuit 2 is connected to the second driving terminal; the control terminal of the first controllable switch T1 in the second and others driving units of the second driving circuit 2 is connected to the upper level scanning line, the control terminal of the eleventh controllable switch T11 of each driving unit of the second driving circuit 2 is connected to the first driving terminal.

In this embodiment, the first driving circuit 1 includes two (the first level and the second level) driving unit 10, the second driving circuit 2 includes two (the first level and the second level) driving unit 10, the first to the eleventh controllable switches T1-T11 are all N-type MOS transistors. The touch scanning of the scanning driving circuit of present disclosure is formed between the first driving circuit 1 and the second driving circuit 2 and two frame interval.

The operation theory of the scanning driving circuit is as followed; the forward scanning of the scanning driving circuit is taken as an example to illustrate:

When the scanning driving circuit is in the forward scanning status, such as the forward scanning control potential U2D is a high electrical level and the reverse scanning control potential D2U is low electrical level, the first driving terminal STV1 input a high electrical level signal, and the second driving terminal STV2 input a low electrical level signal. The control terminal of the first controllable switch T1 of the first level driving unit 10 of the first driving circuit 1 receive a high electrical level signal and conducted, the seventh and the tenth controllable switch T7 and T10 of the first level driving unit 10 of the first driving circuit 1 are conducted, the control terminal of the third controllable switch T3 of the first level driving unit 10 of the first driving circuit 1 receives the high electrical level signal from the forward scanning control potential U2D and conducted and provide a low electrical level signal received from the next clock signal from the input terminal to the control terminal of the fifth controllable switch T5 of the first level driving unit 10 of the first driving circuit 1, the fifth and sixth controllable switch T5-T6 of the first level driving unit 10 of the first driving circuit 1 are stop, the control terminal of the eighth controllable switch T8 of the first level driving unit 10 of the first driving circuit 1 receives the high electrical level from the input terminal of the first controllable switch T1 and conducted and pull down the control terminal of the ninth controllable switch T9 of the first level driving unit 10 of the first driving circuit 1 till to a low electrical level, then the scanning line corresponding to the first level driving unit 10 of the first driving circuit 1 input a high electrical level signal provided by current level clock signal. Since the control terminal of the first controllable switch T1 of the second level driving unit 10 of the first driving circuit 1 connected to the scanning line of the first level driving unit 10 of the first driving circuit 1, the control terminal of the first controllable switch T1 of the second level driving unit 10 of the first driving circuit 1 receive a high electrical level signal and conducted, the seventh and the tenth controllable switch T7, T10 of the second level driving unit 10 of the first driving circuit 1 are conducted, the scanning line corresponding to the second level driving unit 10 of the first driving circuit 1 input a high electrical level signal provide by current level clock signal to achieve turning on all of the transistors controlled by to each of the corresponding scanning line. In the time, the control terminal of the eleventh controllable switch T11 of the driving unit 10 of the second driving circuit 2 receive a high electrical level signal form the first driving terminal STV1 and conducted, and pull down the scanning line corresponding to each of the driving unit 10 of the second driving circuit 2 to a low electrical level to achieve the reset.

After the touch scanning is finished, the first driving terminal STV1 inputs a low electrical level signal, the second driving terminal STV2 inputs a high electrical level signal, the control terminal of the first controllable switch T1 of the driving unit 10 of the second driving circuit 2 receive a high electrical level signal and conducted, the seventh and the tenth controllable switch T7, T10 of the driving unit 10 of the second driving circuit 2 are conducted, the control terminal of the third controllable switch T3 of the first level driving unit 10 of the second driving circuit 2 receives the high electrical level signal from the forward scanning control potential U2D and conducted and provide a low electrical level signal received from the next clock signal from the input terminal to the control terminal of the fifth controllable switch T5 of the first level driving unit 10 of the second driving circuit 2, the fifth and sixth controllable switch T5-T6 of the first level driving unit 10 of the second driving circuit 2 are stop, the control terminal of the eighth controllable switch T8 of the first level driving unit 10 of the second driving circuit 2 receives the high electrical level from the input terminal of the first controllable switch T1 and conducted and pull down the control terminal of the ninth controllable switch T9 of the first level driving unit 10 of the second driving circuit 2 till to a low electrical level, then the scanning line corresponding to the first level driving unit 10 of the second driving circuit 2 input a high electrical level signal provided by current level clock signal. Since the control terminal of the first controllable switch T1 of the second level driving unit 10 of the second driving circuit 2 connected to the scanning line of the first level driving unit 10 of the second driving circuit 2, the control terminal of the first controllable switch T1 of the second level driving unit 10 of the second driving circuit 2 receive a high electrical level signal and conducted, the seventh and the tenth controllable switch T7, T10 of the second level driving unit 10 of the second driving circuit 2 are conducted, the scanning line corresponding to the second level driving unit 10 of the second driving circuit 2 input a high electrical level signal provide by current level clock signal to achieve turning on all of the transistors controlled by to each of the corresponding scanning line. In the time, the control terminal of the eleventh controllable switch T11 of the driving unit 10 of the first driving circuit 1 receive a high electrical level signal form the second driving terminal STV2 and conducted, and pull down the scanning line corresponding to each of the driving unit 10 of the first driving circuit 1 to a low electrical level to achieve the reset.

When the input terminal of the third controllable switch T3 of each of the driving unit 10 of the first and the second driving circuit 1,2 receive the next clock signal is a high electrical level signal, the fifth and the sixth controllable switch T5, T6 are conducted to pull down the control terminal of the tenth controllable switch T10 to a low electrical level signal and stop, the control terminal of the eighth controllable switch T8 receives the low electrical level and stop, the control terminal of the ninth controllable switch T9 receives a high electrical level signal and conducted to achieve pulling down each of the scanning line corresponding to each of the driving unit 10 to a low electrical level and turn off each of the transistor corresponding to each of the scanning line.

During the operation of the reverse scanning status of the scanning driving circuit, such as the forward scanning control potential U2D is a low electrical level and the reverse scanning control potential D2U is a high electrical level, the operation theory is the same with the operation of the forward scanning status of the scanning driving circuit, and not repeat there.

Figure 3:
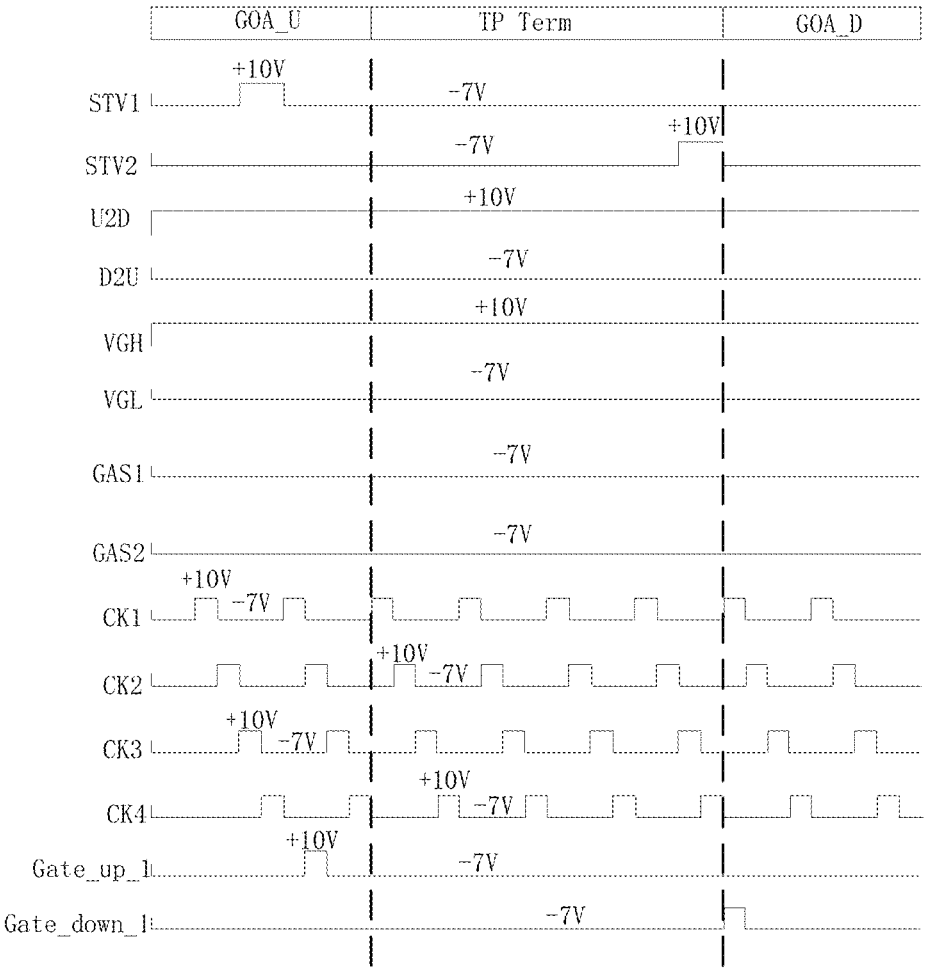
FIG. 3 is a waveform of the scanning driving circuit according to the present disclosure.

Referring to FIG. 3, FIG. 3 is a waveform of the scanning driving circuit according to the present disclosure. As illustrated in FIG. 3, when the first driving terminal STV1 input a high electrical level signal, the second driving terminal STV2 inputs a low electrical level signal, each of the driving unit 10 in the first driving circuit 1 of the scanning driving circuit are conducted, and each of the driving unit 10 of the second driving circuit 2 are all be reset. When the touch scanning is finished, the first driving terminal STV1 input a low electrical level signal, the second driving terminal STV2 inputs a high electrical level signal, each of the driving unit 10 in the second driving circuit 2 of the scanning driving circuit are conducted, and each of the driving unit 10 of the first driving circuit 1 are all be reset to achieve the centralize setting of the touch scanning in the middle of the scanning in the scanning driving circuit. In this embodiment illustrates the circuit between the second level driving unit 10 of the first driving circuit 1 and the first level driving unit 10 of the second driving circuit 2 shown in FIG. 1. By this design to reset each of the driving unit 10 of the first driving circuit 1 and the second driving circuit 2 to clear the influence of the touch scanning to the scanning driving circuit.

Figure 4:
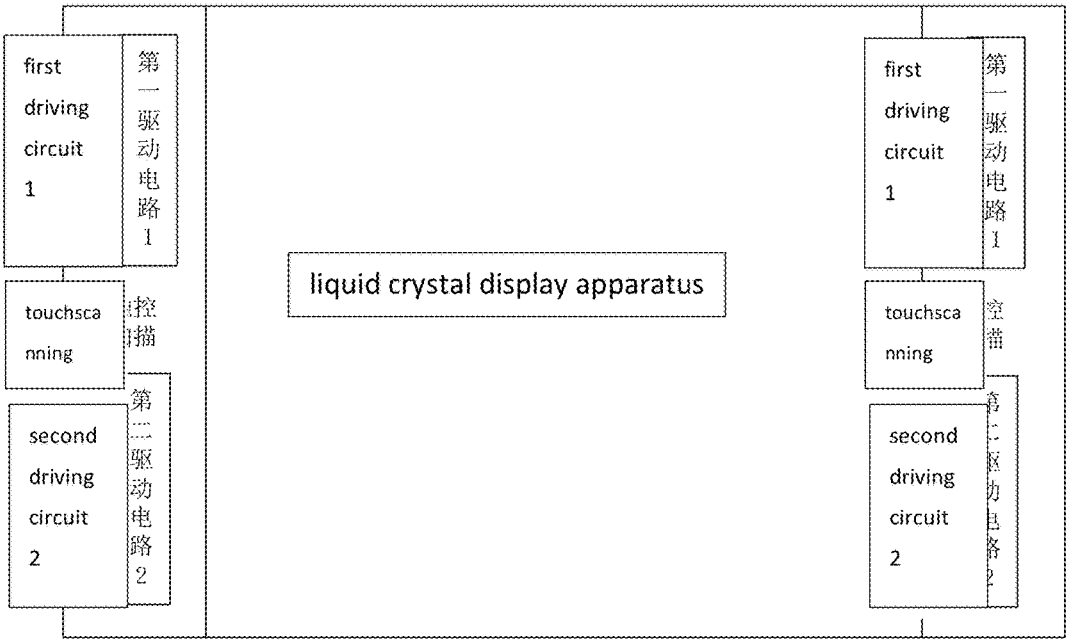
FIG. 4 is schematic structural view of the liquid crystal display apparatus in the present disclosure.

Referring to FIG. 4, FIG. 4 is schematic structural view of the liquid crystal display apparatus in the present disclosure. The liquid crystal display apparatus includes the first driving circuit 1 and the second driving circuit 2 and the first driving circuit 1 is set in the right-and-left sides of the upper portion of the liquid crystal display apparatus and the second driving circuit 2 is set in the right-and-left sides of the lower portion of the liquid crystal display apparatus.

By controlling the conducting and reset of the first driving circuit 1 and the second driving circuit 2 of the scanning driving circuit to achieve the centralize setting of the touch scanning in the middle of the scanning in the scanning driving circuit to decrease the signal break off times of the scanning driving circuit and by the reset of the driving unit to decrease the residual of the electrical charge of the scanning line after the touch scanning.

It will be apparent to those having ordinary skill in the art that various modifications and variations can be made to the devices in accordance with the present disclosure without departing from the scope or spirit of the disclosure. In view of the foregoing, it is intended that the present disclosure covers modifications and variations of this disclosure provided they fall within the scope of the following claims and their equivalents.

Although the drawings and the illustrations above are corresponding to the specific embodiments individually, the element, the practicing method, the designing principle, and the technical theory can be referred, exchanged, incorporated, collocated, coordinated except they are conflicted, incompatible, or hard to be put into practice together.

Although the present disclosure has been explained above, it is not the limitation of the range, the sequence in practice, the material in practice, or the method in practice. Any modification or decoration for present disclosure is not detached from the spirit and the range of such.

What is claimed is:

1. A scanning driving circuit, the scanning driving circuit comprising a first driving circuit and a second driving circuit, the first driving circuit and the second driving circuit comprising a plurality of driving units in cascade connections, and each of the plurality of driving units in the first driving circuit and the second driving circuit comprising:

a forward and reverse scanning module to output a forward scanning signal, a reverse scanning signal and a pull-down signal;

a pull-down maintain module connected to the forward and reverse scanning module and to receive the pull-down signal from the forward and reverse scanning module and output a pull down signal according to the pull-down signal;

a control module connected to the forward and reverse scanning module and the pull-down maintain module, and to receive the forward scanning signal and the reverse scanning signal from the forward and reverse scanning module and the pull down signal from the pull-down maintain module then output a high electrical level or a low electrical level scanning driving signal, wherein the control module comprises a seventh to tenth controllable switches and a capacitor, an output terminal of the seventh controllable switch is directly connected to a control terminal of the tenth controllable switch and an output terminal of the tenth controllable switch is directly connected to the scanning line, directly connected to an output terminal of the ninth controllable switch and directly connected to a reset module;

a scanning line to transmit the scanning driving signal to the pixel unit; and the reset module connected to the pull-down maintain module and the control module to reset the electrical potential of the scanning line;

wherein the forward and reverse scanning module further comprises a first controllable switch, and the reset module further comprises an eleventh controllable switch;

a control terminal of the first controllable switch in a first driving unit of the first driving circuit is directly connected to a first driving terminal, the control terminal of the first controllable switch in each of the rest of the driving units the first driving circuit is connected to an upper level scanning line, the control terminals of the eleventh controllable switches in all the driving units of the first driving circuit are directly connected to a second driving terminal;

the control terminal of the first controllable switch in a first driving unit of the second driving circuit is directly connected to the second driving terminal; the control terminal of the first controllable switch in each of the rest of the driving units of the second driving circuit is connected to the upper level scanning line, the control terminals of the eleventh controllable switches in all the driving units of the second driving circuit are directly connected to the first driving terminal;

when the first driving terminal input a high electrical level signal and the second driving terminal inputs a low electrical level signal, all the driving units of the first driving circuit are conducted, and all the driving units of the second driving circuit are reset; when the touch scanning is finished, the first driving terminal inputs a low electrical level signal and the second driving terminal inputs a high electrical level signal, all the driving units of the second driving circuit are conducted, and all the driving units of the first driving circuit are reset.

2. The scanning driving circuit according to claim 1, wherein the forward and reverse scanning module further comprises a second controllable switch, a control terminal of the first controllable switch is connected to an upper level scanning signal, an input terminal of the first controllable switch is connected to a forward scanning control potential, the output terminal of the first controllable switch is connected to the control module, the pull-down maintain module and an output terminal of the second controllable switch, an input terminal of the second controllable switch is connected to a reverse scanning control potential, and a control terminal of the second controllable switch is connected to a next level scanning signal.

3. The scanning driving circuit according to claim 2, wherein the pull-down maintain module further comprises a third to sixth controllable switches, a control terminal of the third controllable switch is connected to the forward scanning control potential, an input terminal of the third controllable switch is connected to a next level clock signal, an output terminal of the third controllable switch is connected to an output terminal of the fourth controllable switch, and a control terminal of the fifth controllable switch, a control terminal of the fourth controllable switch is connected to the reverse scanning control potential, an input terminal of the fourth controllable switch is connected to an upper level clock signal, an input terminal of the fifth controllable switch is connected to a turn on electrical potential terminal, an output terminal of the fifth controllable switch is connected to a control terminal of the sixth controllable switch, an output terminal of the sixth controllable switch is connected to the output terminal of the first controllable switch and an input terminal of the sixth controllable switch is connected to a turn off electrical potential terminal and the control module.

4. The scanning driving circuit according to claim 3, wherein a control terminal of the seventh controllable switches is connected to the open electrical potential terminal, an input terminal of the seventh controllable switch is connected to the output terminal of the first controllable switch, an input terminal of the tenth controllable switch is connected to a current level clock signal, a control terminal of the eighth controllable switch is connected to the output terminal of the first controllable switch, an input terminal of the eighth controllable switch is connected to the turn off electrical potential terminal, an output terminal of the eighth controllable switch is connected to the control terminal of the sixth controllable switch and a control terminal of the ninth controllable switch, an input terminal of the ninth controllable switch is connected to the turn off electrical potential terminal, an output terminal of the ninth controllable switch is connected to the scanning line, the capacitor is connected between the control terminal and the input terminal of the ninth controllable switch, wherein the ninth controllable switch and the tenth controllable switch are two independent controllable switches.

5. The scanning driving circuit according to claim 4, wherein a control terminal of the eleventh controllable switch receives a reset signal, an input terminal of the eleventh controllable switch is connected to the turn off electrical potential terminal, an output terminal of the eleventh controllable switch is connected to the ninth controllable switch, the tenth controllable switch and the scanning line.

6. The scanning driving circuit according to claim 5, wherein the first to the eleventh controllable switches are all N-type MOS transistors.

7. The scanning driving circuit according to claim 1, wherein the quantity of the driving units in the first driving circuit is the same with the quantity of the driving units in the second driving circuit and the touch scanning circuit is formed between the first driving circuit and the second driving circuit and two frame interval.

8. The scanning driving circuit according to claim 1, wherein the first driving circuit is set in the right-and-left sides of an upper portion of a liquid crystal display apparatus and a second driving circuit is set in the right-and-left sides of a lower portion of the liquid crystal display apparatus.

9. A liquid crystal display apparatus comprising the scanning driving circuit according to claim 1.

* * * * *